US010485270B2

(12) United States Patent
Wesley

(10) Patent No.: US 10,485,270 B2
(45) Date of Patent: Nov. 26, 2019

(54) FLEXIBLE SUPPORT STRUCTURE FOR WIRE-FREE BRAS, BRALETTES AND LINGERIE

(71) Applicant: Monica Wesley, New York, NY (US)

(72) Inventor: Monica Wesley, New York, NY (US)

( * ) Notice: Subject to any disclaimer, the term of this patent is extended or adjusted under 35 U.S.C. 154(b) by 0 days.

(21) Appl. No.: 15/732,760

(22) Filed: Dec. 26, 2017

(65) Prior Publication Data

US 2018/0184726 A1 Jul. 5, 2018

Related U.S. Application Data

(60) Provisional application No. 62/497,244, filed on Nov. 14, 2016.

(51) Int. Cl.

| | |
|---|---|
| ***A41C 3/12*** | (2006.01) |
| ***A41C 3/00*** | (2006.01) |
| *A41F 15/00* | (2006.01) |

(52) U.S. Cl.

CPC ..... *A41C 3/12* (2013.01); *A41C 3/0007* (2013.01); *A41F 15/00* (2013.01)

(58) Field of Classification Search

CPC ..... A41C 3/12; A41C 3/0007

USPC .. 450/19–21, 51, 59, 60, 62, 63, 65, 68, 69, 450/78, 41

See application file for complete search history.

(56) References Cited

U.S. PATENT DOCUMENTS

| | | | | |
|---|---|---|---|---|
| 2,074,796 A * | 3/1937 | Mason, Jr. | A41C 3/00 | 450/65 |
| 2,092,390 A * | 9/1937 | Federico | A41C 3/0021 | 450/60 |
| 2,421,448 A * | 6/1947 | Witkower | A41C 3/0021 | 2/325 |
| 2,458,696 A * | 1/1949 | Solomon | A41C 3/06 | 2/110 |
| 2,498,487 A * | 2/1950 | Solomon | A41C 3/06 | 450/78 |
| 2,683,879 A * | 7/1954 | Dollarhide | A41C 3/0028 | 2/338 |
| 3,200,821 A * | 8/1965 | Anderson | A41C 3/0028 | 2/73 |
| 4,470,419 A * | 9/1984 | DiTullio | A41C 3/00 | 450/19 |
| 5,045,019 A * | 9/1991 | Capasso | A41C 3/00 | 2/73 |
| 5,643,043 A * | 7/1997 | Pflum | A41C 3/0057 | 2/73 |
| 5,660,577 A * | 8/1997 | Modena | A41C 3/00 | 450/86 |

(Continued)

*Primary Examiner* — Gloria M Hale
(74) *Attorney, Agent, or Firm* — Cozen O'Connor

(57) ABSTRACT

A soft brassiere garment with flexible support structure having a fabric wing on each side of the garment, another piece of fabric on each side of the garment at least partially comprised by a bra cup allowing for the projection of the breast, with one edge of each cup attached to a wing, and with a seam formed under each cup and extending along an edge. A piece of elastic applied within each seam where the fabric of each wing meets the fabric of each cup and at least one additional piece of elastic attached to the bottom of the garment, wherein the elastic pieces are attached in such a way that the stretch ratio between different points on the garment is modified to influence the amount of projection afforded by different pieces of the garment.

2 Claims, 10 Drawing Sheets

(56) References Cited

U.S. PATENT DOCUMENTS

| | | | | |
|---|---|---|---|---|
| 6,485,352 | B1 * | 11/2002 | Batcha | A41C 3/0007 450/41 |
| 7,438,625 | B2 * | 10/2008 | Tremblay | A41C 3/00 450/60 |
| 8,241,089 | B2 * | 8/2012 | Otto | A41C 3/00 450/19 |
| 8,651,917 | B2 * | 2/2014 | Lopez | A41C 3/12 450/79 |

* cited by examiner

FLEXIBLE SUPPORT STRUCTURE FOR WIRE-FREE BRAS, BRALETTES AND LINGERIE

CROSS REFERENCE TO RELATED APPLICATION

This application claims benefit to U.S. Provisional application No. 62/497,244, filed on Nov. 14, 2016.

BACKGROUND OF THE INVENTION

1. Field of the Invention

Generally, the technology behind undergarments designed to support the breast throughout daily wear fall into two broad major categories: the underwire bra and the traditional bralette.

2. Related Art

Most women today wear brassieres containing hard structures made of rigid or semi-rigid material, called "underwire." The underwire bra is the most common type of bra worn today—70% of the current market in the United States. This category has several sub-variations, but is described and defined by one element—the presence of an underwire. This material can consist of steel, bone, plastic, or other rigid materials, normally shaped in a semi-circle extending under the breast from anywhere between the point below the armpit to the sternum, and is incorporated into the cup of a bra by being seamed in. The strip of this material is sewn into the fabric of a bra in a seam, shaping the bottom portion of the garment's cup, and intends to encapsulate the wearer's breast. It serves as the main "support structure" of the brassiere, propping up the breast from below, held upwards by an attachment to components of the cup.

Additionally, underwire usually serves to separate and shape both cups. The projection of the cup—referring to how deeply the fabric is able to curve outward, allowing for more volume and space for a breast—is determined by the treatment of fabric on the cup of an underwire bra and its seam placement. Cup projection may be achieved by heat-treating synthetic fabric so it constantly retains volume and depth, or by seaming soft fabrics together. Seam direction can also illustrate points of security and support throughout the cup, providing it in several directions to contain the breasts from different angles of gravity and motion.

However, even the most advanced underwire presents plenty of problems—bending and warping with time, poking and in some cases injuring the wearer by coming loose at the centerfront gore or sideseam near the armpit, ripping and damaging the garment, and generally inducing discomfort and fit problems. The hard structure creates pressure points of discomfort at the sternum, near the armpit, and along the ribcage, depending on the anatomy of the wearer.

The problem is compounded the larger a wearer's breasts are, due to the added weight and stress upon support components. While the support level afforded by underwire is difficult to parallel, most women find it uncomfortable to wear over an entire day, and over extended periods of time, as the structure can wear through fabric, warp its shape, and create a number of fit issues, discomforts, and even injuries, due to the rigidity of the support structure.

Additionally, to prevent the wire from stabbing into the body of the wearer, underwire bras traditionally have to incorporate an additional piece of fabric between the bra cups, separating the breasts (called the center gore.) This gore can have a variance of widths and heights to accommodate the shape of the bra, or purely for aesthetic quality. However, the variance of this structural component, when paired with the rigidity of its support structure and the varied anatomy of its possible wearers, can preclude wearers from achieving a proper fit from the bra. The gore's size can affect whether the cups will actually sit under the breast tissue or on the breast tissue, based on a variety of factors like breast shallowness vs projection, or natural width and separation.

Solutions to the underwire problem include: the underwire channel with added reinforcement of U.S. Pat. No. 9,717,286, changing the shape of the wire and replacing it with a more flexible material as entailed in U.S. Pat. No. 9,386,808, or replacing or encircling the underwire with a support structure that is thermoformed, comprises a foam structure that "props" the breast, and/or additionally incorporates traditional wiring within this soft structure, as detailed in U.S. Pat. No. 8,864,549. However, the basic problems involving the rigidity of wires can affect the implementation of these channels, and still make sizing and manufacturing a more difficult process.

Underwire achieves such a precise fit by using materials that are manufactured exactly for each two-point (band and cup) size. The wire's dimensions are dependent on the band measurement, cup measurement, and relative anatomy, as the width and height may vary significantly and drastically affect fit and comfort levels. This makes production of those styles either contribute to widespread discomfort for buyers subject to improperly sized or proportioned wires, may restrict the design possibilities afforded by the proportions of the wires, or may increase manufacturing and production costs as a wider variance of sizes and shapes may require more physical wires specifically created for each size.

In light of these problems, a growing number of women are seeking garments with softer, less constrictive support structures for increased comfort, style, and compatibility with different garments and lifestyles. The bralette or "soft bra" refers to any design that does not utilize underwire or hard structural elements to shape the bottom band & side seam of the cup. Instead, they often rely on elastic elements and/or additional hardware such as closures and strap adjusters to provide qualities of security and support throughout the fit of the garment. Without wire, bralettes often aim to provide a more relaxed and "natural feeling" fit. However, because of the different strategies of construction used, they often fail to account for providing support against different directions of gravity and motion. For brevity, the following explanation of these construction styles will omit certain styles (such as those lacking any form of elastic support structure) that do not provide support and are not designed to.

Some bralettes may not feature cup projection or definition at all. This is counterproductive on multiple levels. Without projection being afforded specifically to the cup, the breast is squashed and the tissue is allowed to compress itself indeterminately among the rest of the torso, providing little to no shaping and support. Without cup definition, breasts may settle improperly, slip out of elastic boundaries of the band, or may just move in a way that is distracting, painful, or annoying to the wearer as the wearer performs normal, everyday tasks such as walking or raising their arms. In general, the support level is inadequate, in particular for wearers who have more than a four inch difference between the circumference of their torso underneath the breast (the "underbust") and the measurement around the fullest part of their breasts (the "bust")—these wearers require "full cup" support.

Some bralettes may feature projected cups, but also lack an additional side seam. A very common style, the design features one evenly-sewn line of underbust elastic to provide basic band support, but without delineated side support or a distinct "wing"—the side of the bralette covering the side of the wearer's torso cleanly flows into the edge of the cup, cut from the same piece of fabric—fit problems present themselves. Cup projection may be provided by gathered fabric, seaming, or darts. Therefore, the style may only contain breasts in a slight upward direction from the single line of underbust elastic, leaving the cup inflexible and depriving customers of adequate side support, regardless of how roomy the cups are.

Some bralette styles, including longline styles, may attempt to add boning at the side seam to provide greater band support, or add a line of straight side seam elastic applied in such a way that it is perpendicular to the band. However, the lack of curved seaming and the lack of dynamic stretch-to-fit techniques (such as the one outlined in this patent) applied throughout the elastic structure again brings the issue back to a lack of proper cup definition, which undermines adequate security during daily activities, and once again the wearer is missing out on important diagonal support, which provides adequate shaping.

Styles may even add a cup with a curved seam along the side and underside. However, without additional elastics along the cup edge, the seaming provides inadequate support in relation to other elastic-supported areas throughout the structure of the garment. Therefore, more restriction is provided at the side of the torso, and less support is provided to the breasts themselves.

Elastics at the bottom edge of the band only provide a bottom shelf of upwards support. Without elastic on the boundaries of the full cup edge, and without added cup projection, this style of construction provides an inadequate and inappropriate support level for most cups above a 32D & its sister sizes, and little support to smaller sizes.

Furthermore, women are beginning to prefer bralettes because they offer a softer, less constrictive support structure for increased comfort, style, and compatibility with different garments and lifestyles. However, these soft bras & bralettes aren't available or practical to most women. They're often sized using "small/medium/large" sizing, which does not account for the differences between underbust size and bust volume in the way most traditional bra sizes do.

Finally, the problem with most bralettes and soft bras that include underbust elastic can be traced to a construction level. In normal bra & bralette construction, elastic components are cut and applied in one of two ways. They may be cut to match the exact length of the main material that makes up the body of the garment. This method does not utilize the technique of "stretching" an elastic to "fit" a garment. Therefore, it allows only for as much recovery of how much the main material can stretch, even though the elastic is capable of stretching more than the material. This restricts the amount of volume and projection afforded by the material.

Traditional stretch-to-fit methods comprise a material being cut for a given size, with an elastic cut shorter than its corresponding material. In application, the elastic is then stretched to fit around the band (or specified component of the bra) in even increments between given points on the band.

The points between which stretch-to-fit methods are, in normal construction, evenly applied throughout the bottom band.

This allows for extra volume throughout the full design. However, the wearer of a bralette doesn't require extra volume throughout the full design. They require extra volume only in the cup, above the band, and in fact require restraint at the side wing to provide support and shaping. The ratio of how much volume needs to be afforded in the cup region will change according to the band size of the wearer, regardless of if the same physical cup size is maintained. This is an additional problem with the construction methods traditionally in usage today, and another reason why women need alternate solutions.

SUMMARY OF THE INVENTION

The invention disclosed herein is a novel solution to the problems associated with traditional rigid underwire and thermoformed support structures, as well as the problems associated with traditional bralettes & soft bras. The invention is a method and design for constructing a wire-free, sturdy, yet flexible support structure, the method of application of which inherently accommodates and properly fits a wide combination of band and cup sizes.

DETAILED DESCRIPTION OF THE PRESENTLY PREFERRED EMBODIMENTS

Figure 1:
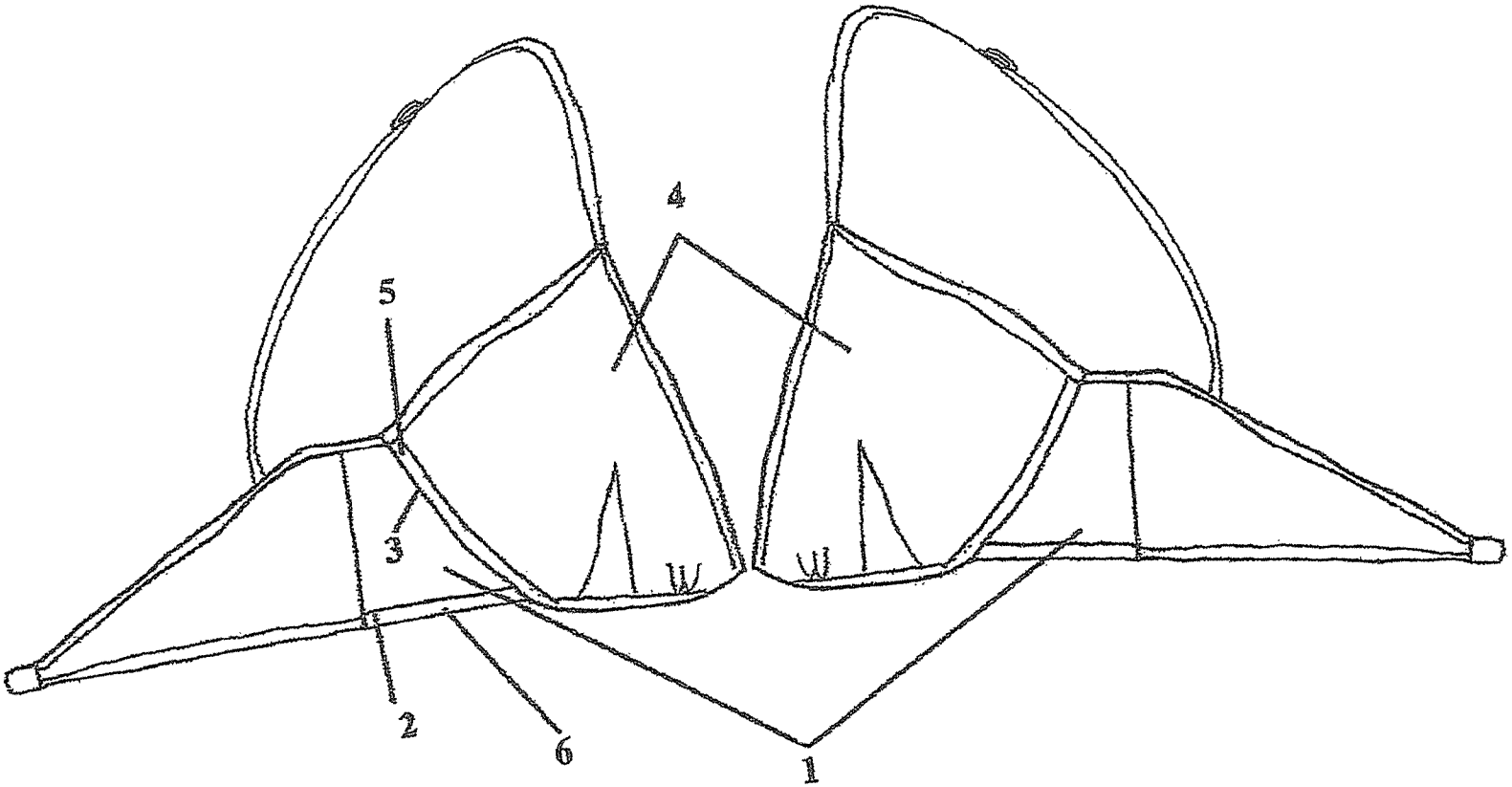
FIG. 1 is depiction of the bra garment according the present invention shown in a flattened state.

FIG. 1 shows a depiction of the invention in a flattened state. A fabric wing (1) runs from the side of the torso to the cup. One edge of this wing (2) runs along the bottom of the garment and another (3) curves down along the side of the breast. The cup (4) is attached to the wing (1) using a seam at their juncture (3) into which a piece of elastic (5) is applied. Another piece of elastic (6) is sewn along the bottom edge of the garment, according to the methods shown with regard to FIGS. 2 and 3.

Figure 2:
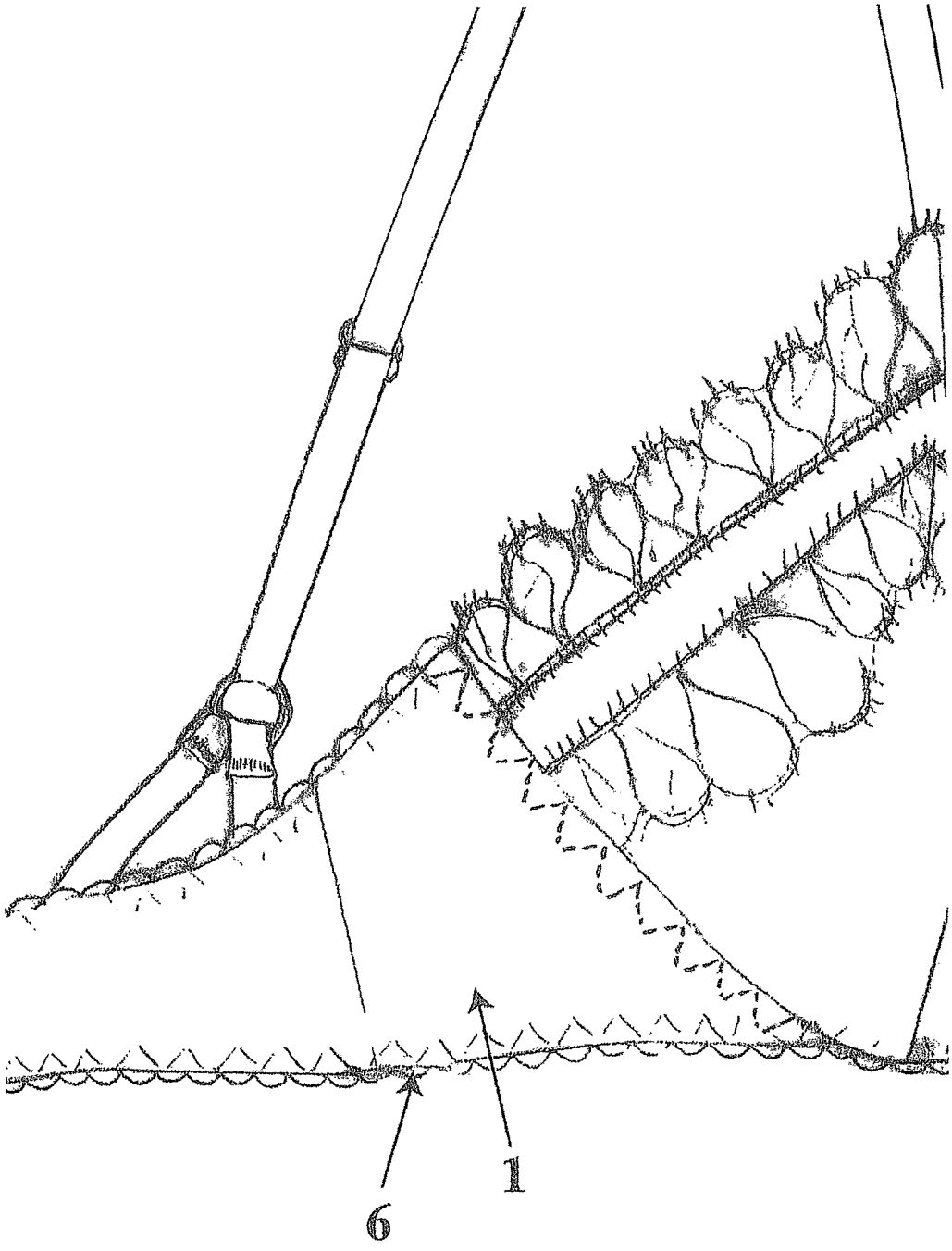
FIG. 2 shows a detail illustrating application of elastic along the bottom edge of the garment.

FIG. 2 shows the application of elastic (6) applied along the bottom edge of the garment. Here it is applied to the same fabric used in the body of the garment's wing (1).

Figure 3:
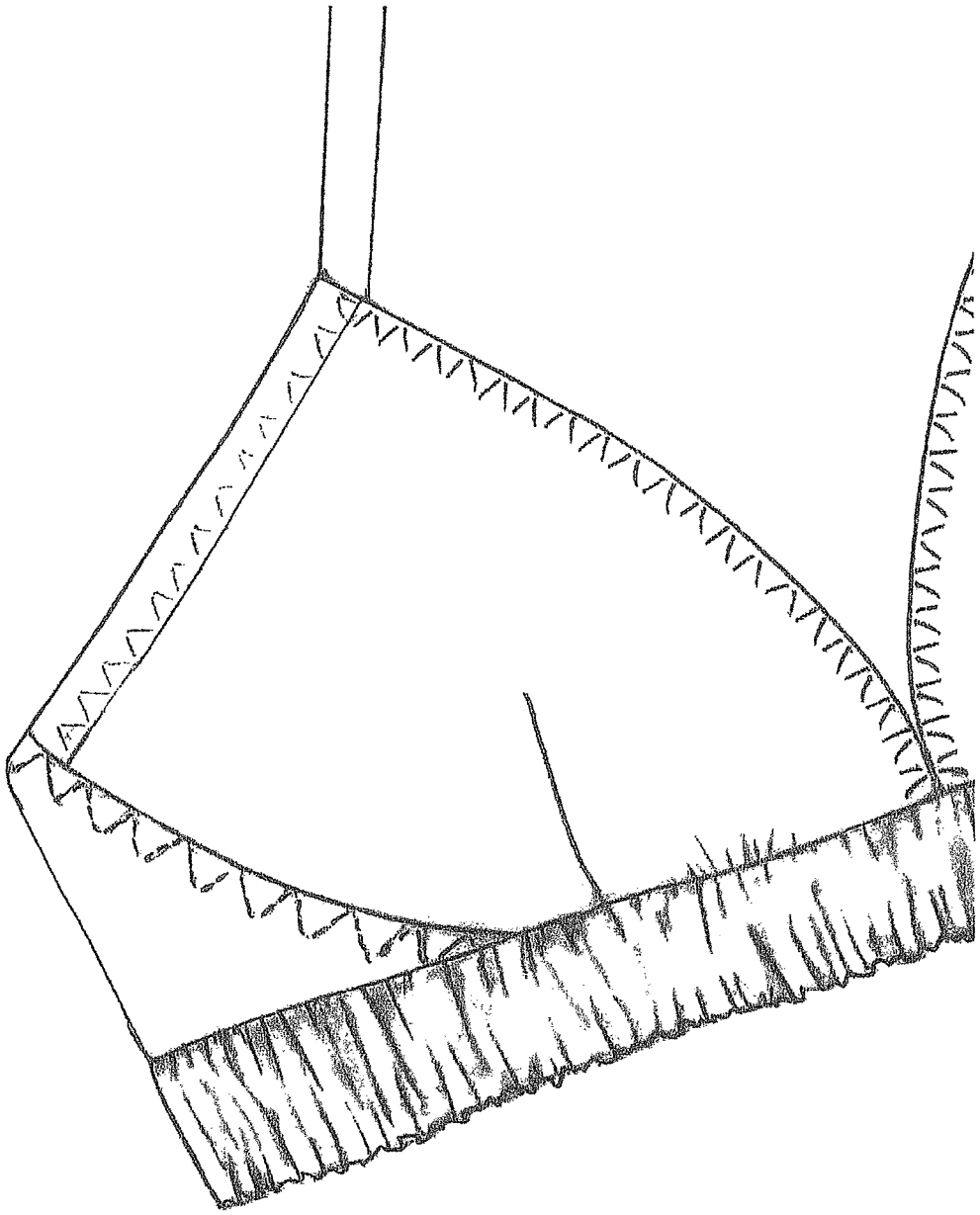
FIG. 3 shows a detail showing another method of band elastic application.

FIG. 3 is a detail showing another method of band elastic application, where the elastic portion of the band is applied within a pocket of material which is then attached to the body of the garment.

Figure 4:
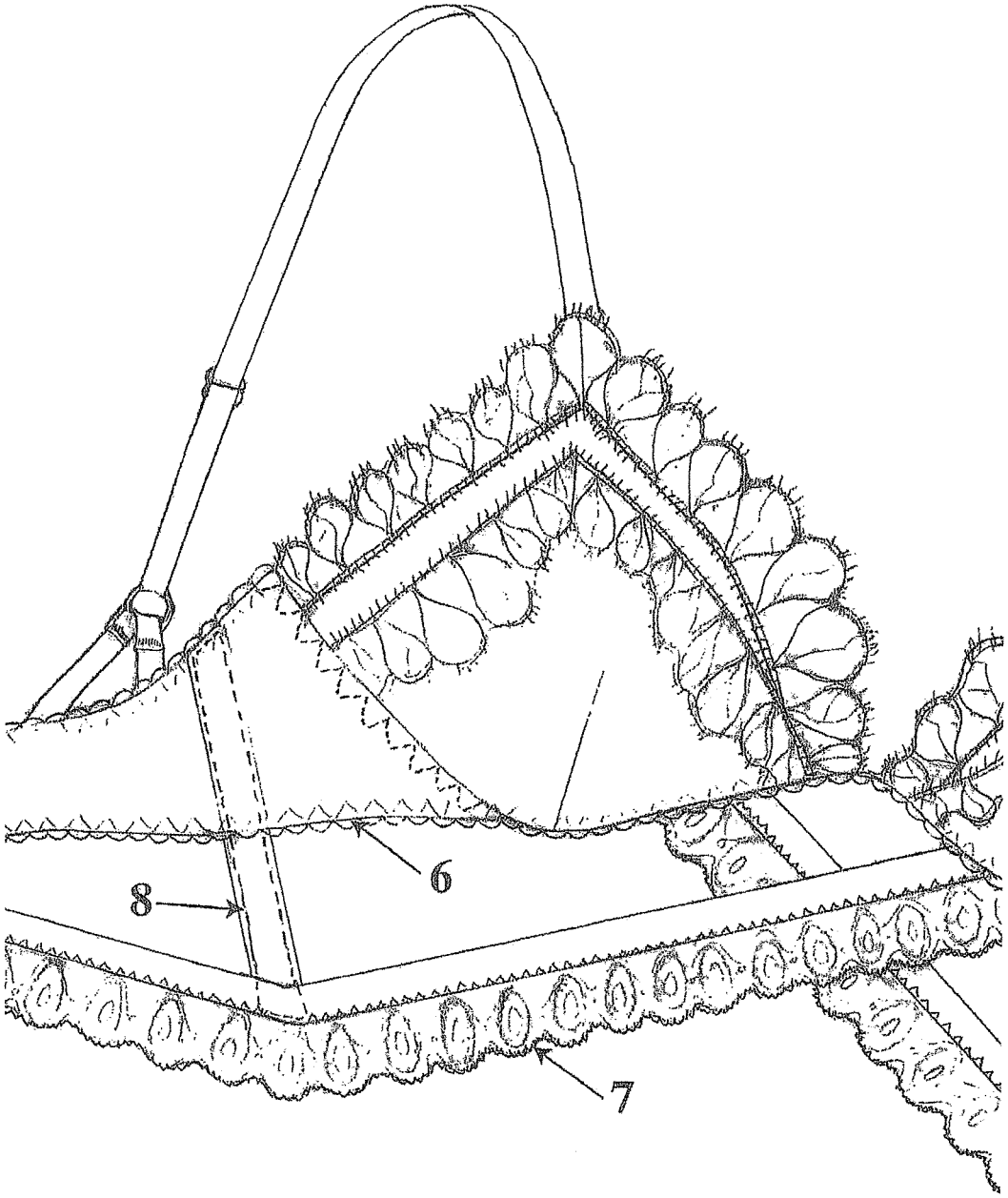
FIG. 4 shows a detail of a variation of the invention.

FIG. 4 illustrates a detail of a variation of the invention, in which the band comprises a main band (6) attached to the body of the garment and a supplementary band (7) that wraps and supports different components. In this example a channel of fabric encasing a flexible boning (8) attached to both pieces of the band provides additional shaping and security.

Figure 5:
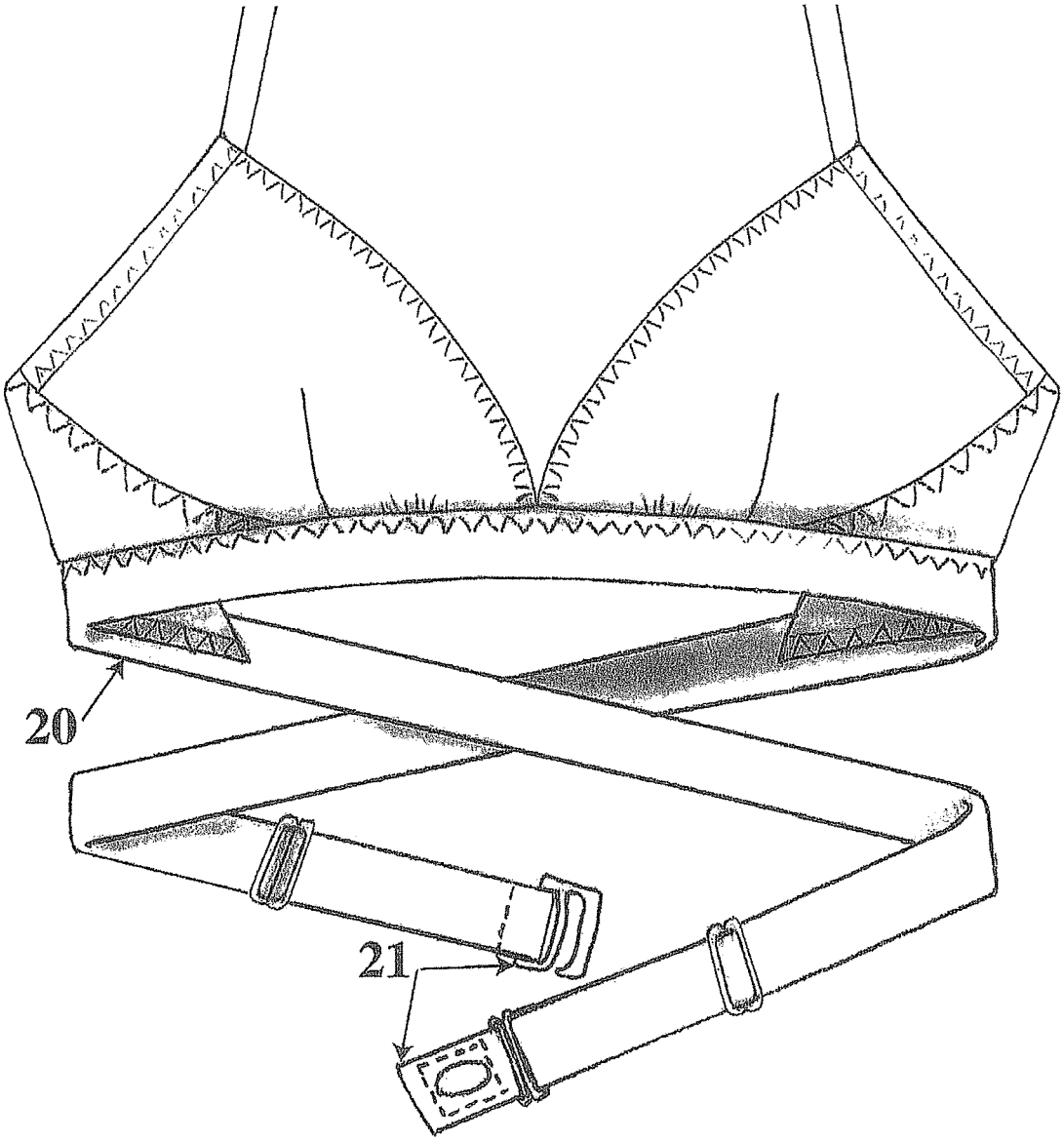
FIG. 5 shows a detail of a variation of the invention.

FIG. 5 illustrates a detail of a variation of the invention, in which the band comprises a continuous loop of fabric (20) that, when worn, run parallel to each other and share a connection with any back or front closure hardware (21), such as hook and eye or other fixtures.

Figure 6:
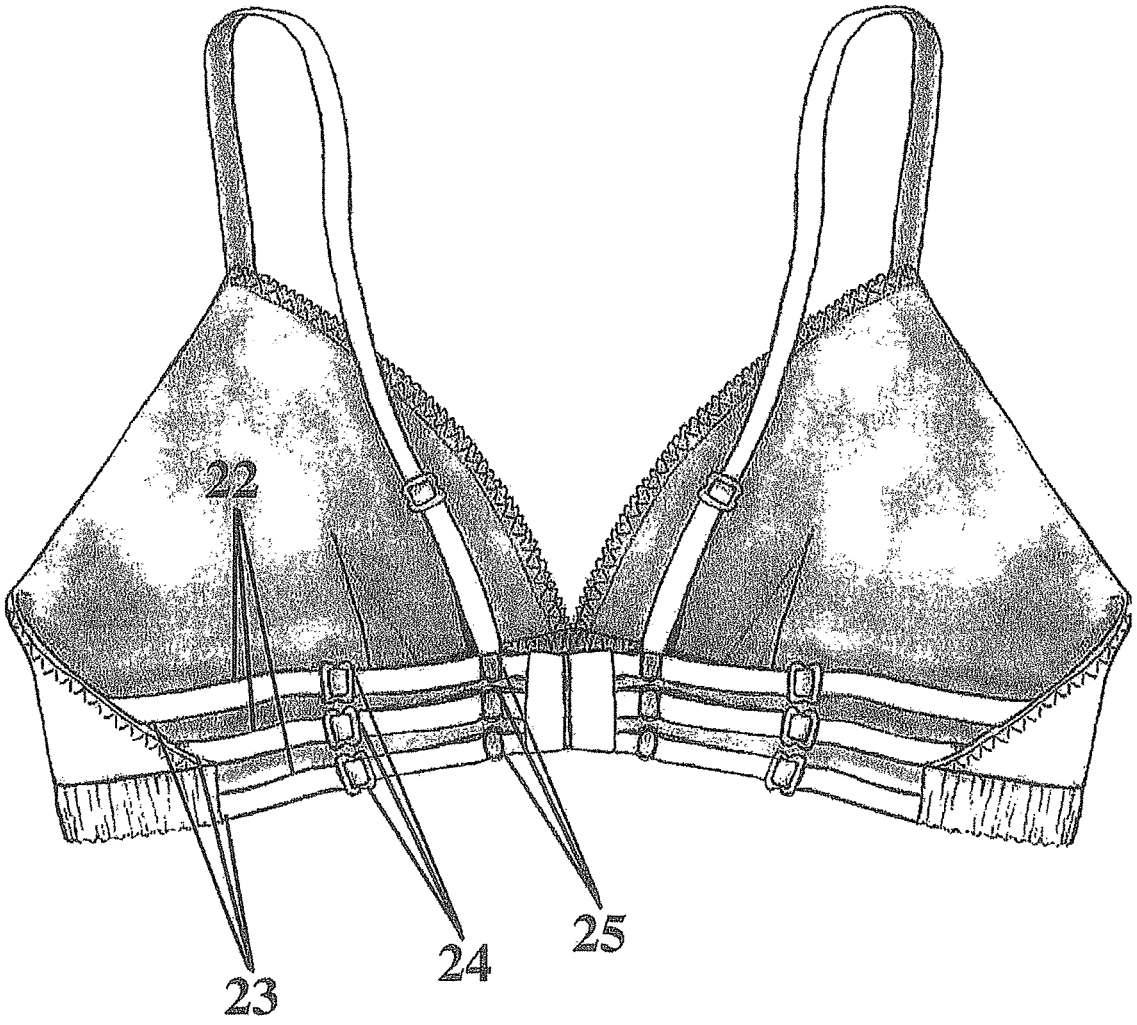
FIG. 6 shows a detail of a variation of the invention in which the band comprises multiple channels of elastic unattached to a fabric body.

FIG. 6 illustrates a detail of a variation of the invention, in which the band comprises multiple channels of elastic (22) that are unattached to a fabric body, but meet the rest of the garment at their end points (23, 25). The channels may feature sliders (24) or other means of adjusting their length, which give the wearer increased control over the security and adjustability of the fit.

Figure 7:
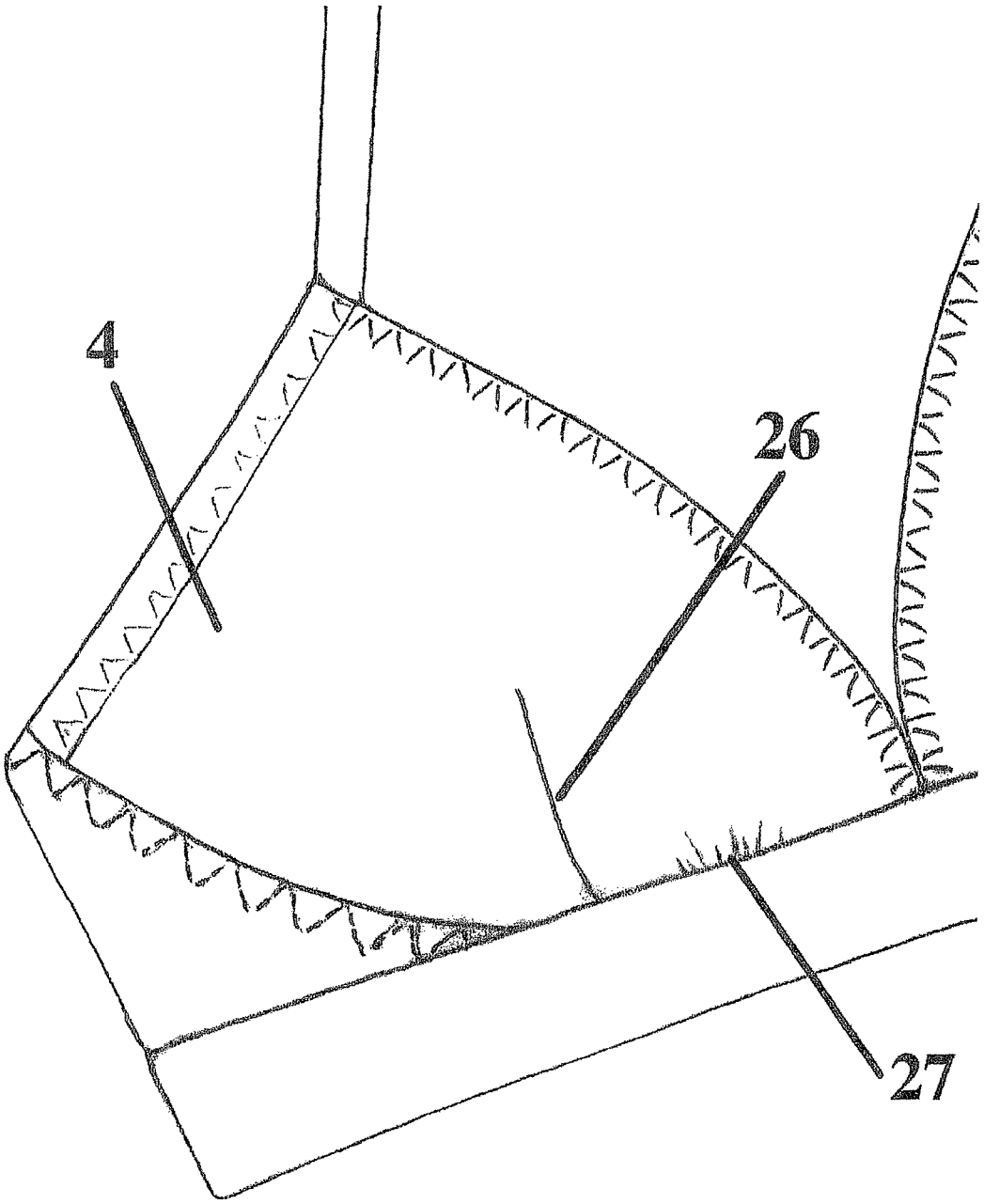
FIG. 7 shows a detail of the invention highlighting the cup of a garment.

FIG. 7 illustrates a detail of the invention highlighting the cup (4) of a garment, with both darts (26) and gathers (27).

Figure 8:
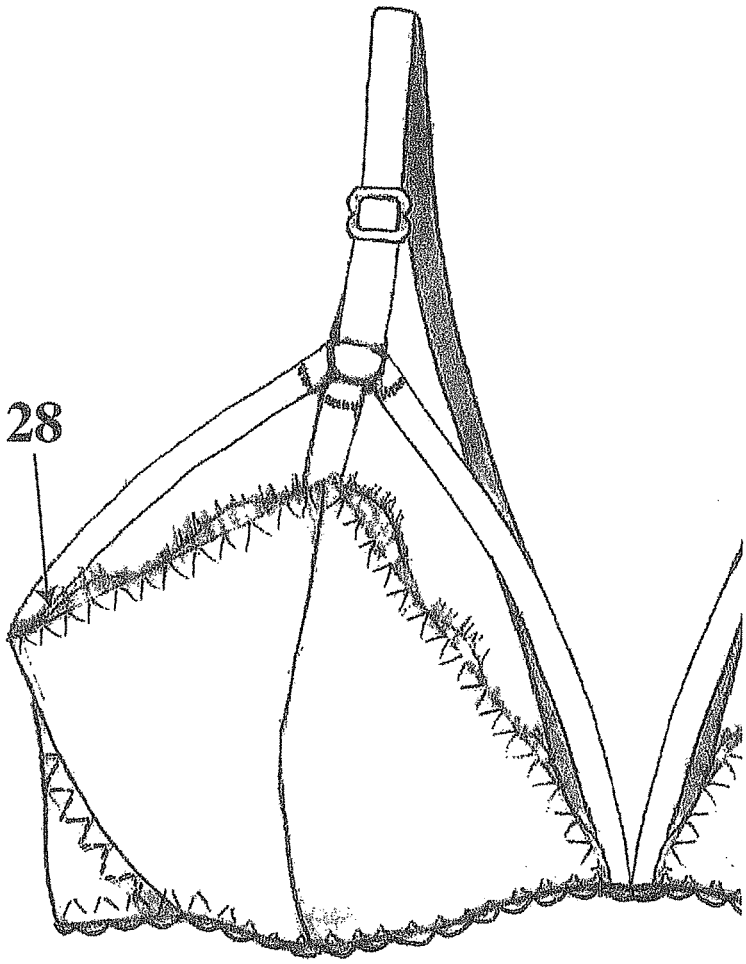
FIG. 8 shows a detail of a bralette featuring a demi-cup with supplementary straps.

FIG. 8 illustrates a detail of a bralette featuring a demi-cup with supplementary straps (28).

Figure 9:
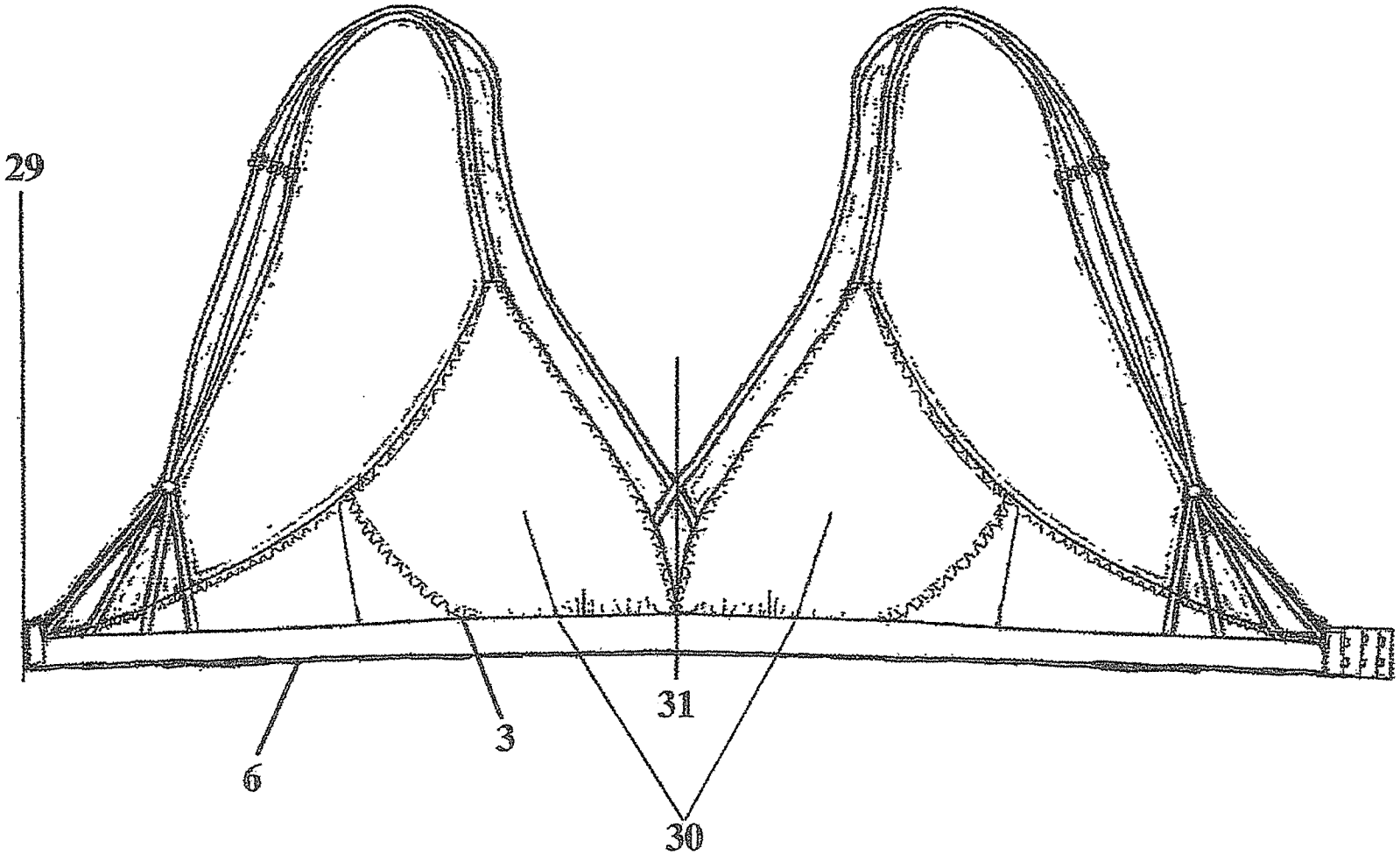
FIG. 9 illustrates points at which elastic along the band is applied using the dynamic stretch-to-fit method.

FIG. 9 depicts the points at which elastic along the band is applied using the dynamic stretch-to-fit method. Extra allowance underneath the breast is eliminated by using a greater ratio of elastic to material, reducing the severity of the elastic stretch, between the band ends (29) to the seam where the cup and wing meet (3). A more severe stretch is applied between the points of the seam where the cup and wing meet (3) and the centerfront (31), increasing the projection afforded at the cup's center (30).

Figure 10:
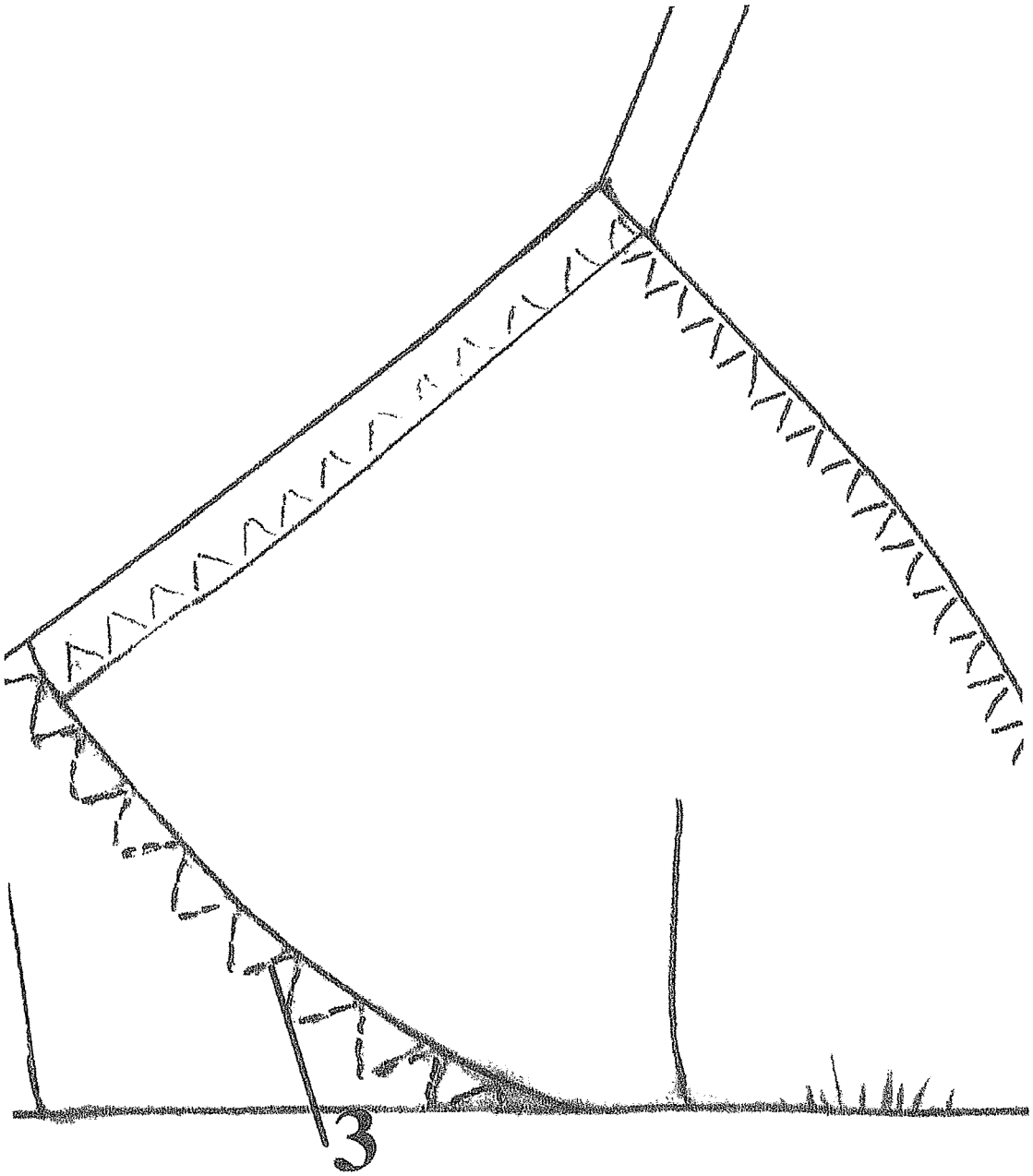
FIG. 10 shows a detail of the curved sideseam elastic, applied with the dynamic stretch to fit method.

FIG. 10 shows a detail of the curved sideseam elastic, applied with the dynamic stretch to fit method. This elastic is applied at the seam connecting the wing of the garment to the garment's cup. (3)

Disclosed herein is a flexible support structure for a soft brassiere (3), comprising:

1. A fabric "wing," (1) running from the side or back of the torso, the bottom edge (2) running along the bottom of the garment and one side edge (3) curving down along the side of the breast to meet at any point along the outer side edge or bottom edge of the breast.

2. Another piece of fabric, (4) at least partially comprised by the bra's "cup," allowing for the projection of the breast, with one edge (3) attached to the wing (1) by a method such as a seam 3. A piece of elastic (5) applied within the seam where the fabric of the wing meets the fabric of cup (3) and running along the outer edge and to the underside of the breast, supporting the cup.

4. At least one additional piece of elastic, attached to the bottom of the garment, known as the band elastic (6) running along the bottom edge of the wing (2) and meeting the piece of elastic referenced above at one point.

5. A method of sewing or applying the elastic referenced in points 3 and 4 in which the normal technique of stretching an elastic to fit a garment is modified to influence the amount of projection afforded by different pieces of the garment.

Optimally, though not mandatorily, the fabrics referenced in points 1 and 2 should at least provide some amount of stretch, such as an elastomeric. mesh. The rest of the bra cup may also comprise other combinations of materials for aesthetic or technical purposes, such as silk, laces, jersey, or other fabrics. This disclosure deals with the application and placement of the elastic inside the seam of the adjoined wing and cup pieces and its relation to the overall structure and support, smoothing, and shaping properties of the garment.

The support of this garment, at its most base and simple application, is provided by multiple components:

Function of the Band

The usage of an elastic material for the base of the band provides breast support.

The band comprises at least one piece of elastic (6). This elastic is most often attached directly to the fabric body of the garment. In cases where it is directly attached, it may be applied directly to the fabric as a trim or accent where it is attached to the underside or front of materials such as elastomeric mesh, jersey, silk, decorative laces, or other fabrics that comprise the body of the garment. It may instead, or additionally, comprise a seam into which elastic is applied.

In another case, it may be applied into a pocket of fabric, such as jersey, silk, mesh, or another material, which is attached to the body of the garment by a seam. Those fabrics may be gathered around the elastic of the band or simply enclosing it, as long as the elastic can stretch within the material utilized. The allowance of the elastic's stretch and recovery in such an application can be achieved by utilizing gathers or other techniques for allowing nonstretch materials to expand with wear, or the pocket material may consist of stretch materials as well that are cut to recover along with the elastic inside of them as described.

The band runs along the bottom edge of the garment at least from under the cup edge until any point where the back of the garment is truncated by back closures, additional adjustable straps, or closures. However, it may run along any percentage of the materials encompassing the full circumference of the torso on the body. For example, if the garment does not have a back closure that consists of a separate component attached to the band, the band may encircle the entire torso and wrap around the full amount less than once, or one or more times.

The materials comprising the body of the garment may be cut to any length and cover very little of the wearer's torso, or they may be cut longer and cover more of the wearer's torso such as in a longline style. The material could also be supplemented or shaped by flexible boning (8) applied in channels encased by fabric throughout any amount of the fabric, running perpendicular to the band elastic. The material may also comprise the wing of the garment, or it may truncate and meet a separate wing material. If it does comprise the wing of the garment, it may truncate at the cup's side or cup's underside where it meets that seam, or it may additionally run underneath the cup, such as in a longline style. The elastic of the band may be applied with any combination of stitches that preserve or contribute to the stretch and functionality of the elastic, such as serged stitches, overlocked, or zig-zagged stitches.

The elastic should be cut to a length smaller than the intended wearer's band measurement (the circumference of the torso) by several inches. This will cause the elastic to attempt to pull itself to a smaller size while still fully encircling the wearer's torso. (The exact method for applying this length relative to the wearer's measurements will be detailed below.) As the elastic tenses around the body and attempts to recover to its natural stretch, it pulls the body in a gathering motion directed mostly to the front of the garment, due to the projection afforded by the cup. This helps pull breast tissue away from the underarm and side of the torso along the wing and into the cup, and furthermore sustains breast tissue above the band from the suspension of the elastic. The tension created by the elastic's natural attempts to recover provides a snug support as the tension pulls "around" the torso towards the front of the garment and as the tension additionally pulls "upwards." This provides lift and basic shaping.

The band in total may comprise multiple components that each contribute to this functionality. For example, the main band of the garment may be laterally reinforced with an additional band (7) also comprised of an elastic material, such as a stretch lace, trim, "pocketed" elastic, or other material that runs parallel to the main band (6). This additional band or strapping (7) helps contribute to the proper support of tissue and directional movement of the tissue in upwards and inwards directions. This additional band and the main band may be attached at various points, for example, they may share connection at the side torso, front, or back with one or more channel(s) of flexible boning (8) or other material encased in fabric.

The additional band and main band may also be a continuous loop of fabric (20) that, when worn, run parallel to each other and share a connection with any back or front closure hardware (21), such as hook and eye or other fixtures. The band itself could also comprise multiple elastic channels arranged in a parallel or lattice configuration—at the front or side of the garment, meeting the wing of the garment, made of a stretch material, or meeting directly with the cup's underside; at the back, meeting with the closures of the garment, or alternately the elastic channels may themselves comprise the entire back of the garment. A band comprising these channels of "open" elastic (22)—that is, elastic pieces which connect to the rest of the garment at their end points (23, 25) but are not all fully stitched along a fabric body—may incorporate sliders (24) or other means of adjusting their length, which give the wearer increased control over the adjustability and security of the fit.

Function of the Wing

The wings of the garment (1)—pieces of fabric applied to the sides of the torso—are sewn to meet the band of the bralette in such a way that the projection of each wing is restricted by its own level of stretch. That is to say, if the wing of the garment utilizes a stretch material, it will be stretched to fit in accordance with the band so that it will attempt to recover its shape by returning to its original length, much like with the band elastic. This original length measures at a shorter level than the actual area it covers on the side of the body. Therefore, it contains and directs tissue in an "inward" direction, providing smoothing properties and contributing to the overall support structure of the garment. Additionally, when the material used has four-way stretch, it contributes to the upward lift of the garment as a whole. These properties may also be attained by using a material with less stretch or non-multi-directional stretch, but the length of the material used must be altered and other design components become more important or integral in maintaining a proper balance between support/lift and allowance/comfort. A channel of "stretch-to-fit" elastic (referred to as "curved sideseam elastic" within a seam lies at the seam between the wing and the cup. (5)

Function of the Cups

Generally, the cups of the bralette (4) comprise at least one layer of fabric, which is intended to encompass a portion of the breast. They each comprise at least one curved fabric cut to cover a majority of the breast. Alternately, it could consist of a smaller piece of fabric that is meant to cover or support only a portion of the breast, such as in a demi cup, quarter cup, or shelf style bra.

The cup may be comprised of just one piece of fabric, such as a stretch mesh, knit jersey, woven silk, or decorative lace with or without stretch properties. Each cup may also comprise multiple layers of fabric, such as a silk or jersey (19) lined with a stretch mesh or other material (20). When the cups of the garment each comprise multiple layers of fabric, the fabric on the outside may cover a smaller area compared to the lining fabric, or they may cover the same area. Additional fabrics such as decorative trims or laces (21) may be applied to either or both fabrics.

The fabrics utilized for the cup may be applied to each other for a combination of decorative or functional purposes, such as lace trims applied to the cup edges, silks applied to a mesh base, knits applied to a mesh base, mesh lining another material, mesh double-layered for increased opacity, a combination of laces or meshes seamed together along the cup, or other combinations.

If each cup consists of fabric, it should provide projection for the breast and may utilize one or several techniques to create allowance for the breast to be contained by the projection of the cup. This may entail utilizing stretch materials applied in such a way that projection allowance is afforded, such as with utilizing gathers (27). It could also entail using darts (26), and greater allowance of projection is often achieved by using both. The room created for each breast to be encompassed by the cup, or to be gathered into the space designated by the cup, allows the tension created by the other components of the bra such as the band (6) and dynamically stretched-to-fit curved sideseam elastic (5) to push breast tissue to the front of the body, and additionally allows for the elastic components of the overall garment structure to support this tissue in an upwards direction. The presence or size of projection-affording features such as gathers may vary with the measurement of the wearer, as afforded by the "dynamic stretch-to-fit" method of elastic application detailed below.

Further Commentary on Methods of Elastic Application

The "dynamic stretch-to-fit" method of application used to apply the elastics in the flexible support structure outlined above accounts for sizing differences related to support retained by the volumetric similarity between sizes by instituting a combination of construction techniques that vary across sizes. This application method of the flexible support structure allows for appropriate levels of both cup projection and support level. In combination with the under-wing elastic placement, the application makes up a wireless, flexible support system appropriate for any combination of cup and band sizes.

In the design, the "stretch-to-fit" is distributed in varying amounts throughout the bottom of the band. For equivalent amounts of cup volumes and increasingly smaller band sizes, the elastic that runs along the band (6) from its ends (29) to the curved side seam (3), is applied with a more severe stretch, so that the tension created by increased stretch is greater for equivalent amounts of cup volumes where the projection is more concentrated to the breast.

Cup sizes with different amounts of volumetric difference between underbust and bust may utilize different variations of gathered cups along the band to afford for increasing levels of projection. To facilitate this, a gather stitch may be created in from the cup center (30). For adequate support, the person must not have extra stretch underneath their breasts (the band should not be cut longer than the amount it actually entails), and they do not need more volume or stretch along the band (6) from its ends (29) to the curved sideseam (3). However, they require more volume above the band, between the curved sideseam (3) and the centerfront (23) of the garment.

In normal construction methods, the elastic is just stretched evenly along the entire band between these points. That application sacrifices needed elasticity, which keeps the band snug under the bust. In the method presented here, the support structure as a whole gains more elasticity, leading to stronger support, and it also provides adequate levels of cup projection, which ensures the band remains under breast tissue, supporting from below. This method retains the support level between "sister sizes"—garments which have the same volumetric needs (that is, the cups of each garment are designed to hold the same volume), but two different band measurements. This support structure assumes extra projection for the person with a larger difference between bust and underbust.

This accounts for a more specific sizing system (and produces more accurately fitted garments) based on multiple measurement points. Because it utilizes a flexible material, the material itself can be adapted to the construction of many different sizes. Its measurement, cutting, and application within the garment provides the specificity of fit required for consumers with large variances between their underbust and bust sizes.

Function of the Curved Sideseam Elastic

The shaping and lift is further elevated by the inclusion of the curved sideseam elastic. This seam (3) connects the wing (1) of the garment to the garment's cup. (4) The seam is applied in a curved shape, and elastic is applied within the seam. The elastic, additionally, is applied in a dynamic stretch-to-fit fashion, allowing for differing levels of projection and tension based on garment sizing.

The elastic must be applied in a manner that utilizes and accommodates stretch materials, such as any combination of overlocked, zigzagged stitches, etc. For example, the elastic could be applied with a serged seam, and then reinforced and gone back over with a three-point zigzag stitch for added security. This very sturdy application of elastic mimics the function of underwire—its application to the components of the wing and cup helps to contain and support breasts, directing tissue in simultaneous "inward" and "upward" directions. However, being composed entirely of flexible materials, it does not suffer from the breakage, warping, and long-term structural issues presented by underwire.

Supplementing the band elastic (which provides shaping throughout the majority of the garment) with specified cup elastic cut along the contours of the breast allows for the properties of elastic to be utilized to concentrate tension (and therefore support) where it is most required in the garment. It also helps ensure that the elastic follows the contours required for projection in the places where the garment needs more projection (the cups.) The methodology utilized to ensure this is the "dynamic stretch-to-fit" method of construction outlined above.

Commentary on Supplementary Structural Elements Relative to the Cup and Shoulder Straps The components above provide more than enough support for the average wearer and comprise a fully featured support system. However, design variations may incorporate other elements that are decorative, functional, or both. Strap placement is one of these. Shoulder straps may be each applied to a cup and connect with the garment again at a band or central closure on the back of the garment. They may be adjustable utilizing sliders or other hardware for either their full length or only a portion of their length based on other design features. They may fork out at multiple points and reconnect to the band. They may cross each other or run parallel and not meet at all. They may consist of, rather than one elastic strap per side, multiple supplementary shoulder straps of varying widths or uniform widths.

Additional straps (28), either comprising or including elastic materials or materials which may be adjusted with hardware such as sliders or hooks, may run from the shoulder straps to any point on the cups, helping to pull the cup in an upwards direction diagonally and centering the support more on the direct centerfront of the garment. This may enhance or adjust the shaping of the garment. Straps may be applied as two or more pieces of fabric or elastic crossing once and meeting on the edge of the cup opposite of the strap edge they are attached to. They may not cross at all and truncate at the edge of the cup on the same side as the strap edge they are attached to. They may be applied as multiple pieces of fabric or elastic that cross or weave in and out or over or under each other such as in a lattice or other pattern. Straps may also be attached to the shoulder strap or cup and encircle the neck in a halter design, truncating at a closure or continuing to the band or back to another cup. Straps may be attached to the cup's highest point either by being applied directly with stitching or by looping through an o-ring that the cup material also loops through, with both loops of each component completed by being stitched down back to themselves. Other straps may be incorporated as part of the component of band support on the lower portion of the garment, as described in a prior section.

The invention claimed is:

1. A garment forming a soft brassiere with a flexible support structure, the garment comprising:

first and second fabric wings arranged on respective first and second sides of the garment, running, when the garment is worn by a wearer of the garment, from a side or back of a torso of the wearer, a bottom edge running along a bottom of the garment and one side edge of each of the first and second wings curving down underneath one of the wearer's breasts to meet at any point along an outer side edge or a bottom edge of the respective breast;

first and second pieces of fabric arranged on the respective first and second sides of the garment, each of the first and second pieces of fabric at least partially comprised by one of two cups of the brassiere, and configured and arranged so as to facilitate projection of the wearer's breasts, with one edge of each cup attached to a respective one of the first and second wings by one or more seams of the brassiere;

a first piece of elastic, applied within each seam where each of the first and second fabric wings meets fabric of a respective one of the two cups and running along the outer edge and underside of each of the wearer's breasts, so as to support the respective cup associated with each breast; and a second piece of elastic, attached to the bottom of the garment, forming at least a portion of a band of the garment, and running along a bottom of each respective wing and meeting the first piece of elastic, wherein the first and second pieces of elastic are sewn in the garment such that a stretch ratio between different points on the garment is modified to influence the amount of projection of the wearer's breasts is afforded by different pieces of the garment.

2. The garment forming the soft brassiere as claimed in claim 1, further comprising one or more straps crossing any point of the wearer's shoulder or extending from a front to a back of the garment, the one or more straps being respectively connected to each cup and connected to the garment again at a point on the band, a fabric body of the garment, or a closure point on the back of the garment.

* * * * *